US006252491B1

(12) United States Patent
Marbacher

(10) Patent No.: US 6,252,491 B1
(45) Date of Patent: Jun. 26, 2001

(54) PLUG FOR AN APPLIANCE HAVING A FUSE

(75) Inventor: Bruno Marbacher, Kriens (CH)

(73) Assignee: Schurter AG, Luzern (CH)

( * ) Notice: Subject to any disclaimer, the term of this patent is extended or adjusted under 35 U.S.C. 154(b) by 1146 days.

(21) Appl. No.: 08/711,996

(22) Filed: Sep. 10, 1996

Related U.S. Application Data

(63) Continuation of application No. 08/354,245, filed on Dec. 12, 1994, now abandoned.

(30) Foreign Application Priority Data

Feb. 2, 1994 (CH) ..... 0305/94

(51) Int. Cl.[7] ..... H01H 85/02; H01R 33/95

(52) U.S. Cl. ..... 337/187; 337/197; 337/208; 337/215; 439/622

(58) Field of Search ..... 337/186, 195, 337/197, 208, 213–215; 439/621, 622

(56) References Cited

U.S. PATENT DOCUMENTS 4,959,025 * 9/1990 Eberhard et al. ..... 439/622

* cited by examiner

*Primary Examiner*—Jayprakash N. Gandhi
(74) *Attorney, Agent, or Firm*—Breiner & Breiner

(57) ABSTRACT

A insulating body supports contact pins which are insulated against each other and extend from the outside through the insulating body to the inside. At the inner side which in use is enclosed in a housing of the appliance and thus is not accessible from the outside, at least one electrical fuse is located which is connected in an electrically conducting manner to the corresponding contact pin and the corresponding inner connecting member. An exchanging of the fuse wire insert is possible only from the inner side when the housing of the appliance has been opened, thus only by a skilled person. This allows a simple and low cost solution.

4 Claims, 1 Drawing Sheet

PLUG FOR AN APPLIANCE HAVING A FUSE

This application is a continuation, of application Ser. No. 08/354,245 filed Dec. 12, 1994, now abandoned.

BACKGROUND OF THE INVENTION

1. Field of the Invention

The present invention relates to a plug for an appliance and having a fuse, including an insulation body which supports contact pins which are insulated against each other and extend from the outer side to the inner side through the insulation body and are connected at the inner side in an electrically conducting manner to respective inner connectors.

2. Description of the Prior Art

Plugs for appliances which have a fuse are generally known. The fuse is accessible at the side of the plug which is located at the outer side of the appliance when in use, in other words, from the outside. Generally, the fuse is designed as a fuse supporting member having a removable supporting member for the fuse wire insert and an exchangeable fuse wire insert. The production necessitates high expenditures.

When the fuse wire insert at such a plug for an appliance has interrupted the electric current the non-skilled person can simply exchange the fuse wire insert from the outside, thus from the outside of the appliance.

It is now increasingly possible to protect an appliance against electrical misfunctions, which have causes outside of the appliance electronically i.e. without fuses.

In such a case the fuse wire insert acts as last protection when all other protection circuits in the appliance fail. Therefore, when the fuse wire insert has been interrupted a defect inside of the appliance is present. The defect must, therefore, be repaired before exchanging the fuse wire insert. As a rule, the non-skilled person cannot perform such a task. Therefore, it does not make sense or even may be dangerous to leave the exchanging of the fuse wire insert up to the non-skilled person. In such cases where grave risks could be encountered the fuse for such reason has been mounted inside of the appliance in such a manner that practically only the person skilled in the art could exchange the fuse wire insert. Such fuses would have to be mounted and connected seperately which in turn gives rise to a high expenditure.

SUMMARY OF THE INVENTION

It is, therefore, a general object of the invention to provide a structure which confines the exchanging of the fuse wire insert to a person skilled in the art without giving rise to the high expenditures associated with the known fuses.

A further object is to provide a plug for an appliance having a fuse, located at the inner side, which in use is enclosed in a housing of the appliance and thus is not accessible from the outer side at least one electric fuse between a respective contact pin and a respective inner connector.

Such as is the case with a known fuse, which as a separate structural member is mounted separately at the inside of the appliance and is connected separately, the exchanging of the fuse wire insert only from the inside when the appliance is opened can only be done by a person skilled in the art in case of the present invention. But the expenditure for a separate structural member which must be mounted and connected separately is no longer present. It is, additionally, also possible to use very simple holding elements for the fuse because they obviously are protected inside of the appliance against the access by a person not skilled in the art which leads to a large saving on expenditures in comparison with commonly known plugs for appliances having a fuse. Due to the protected position of the fuse inside of the appliance it is not necessary to foresee a protection against contact by a person in form of specific sealing structures at the fuse holder.

Advantageously, however, it is possible to cover the parts which are live, carry current against the inside by a simple inner cover.

The producing of the inventive appliance plug is quite simple, and it also can be mounted and connected quite easily.

Preferably only one insulating member which receives the parts of the plug and the fuse is present.

Preferably, the fuse can be foreseen between the pin of the plug which projects to the outside and the inner connector of the plug. It is for instance possible to foresee for this case a simple clip fuse holder with a fuse wire insert. Even smallest fuses such as micro-fuses and surface mounted device (SDM) fuses can be used advantageously.

BRIEF DESCRIPTION OF THE DRAWINGS

The present invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENT

Figure 1:
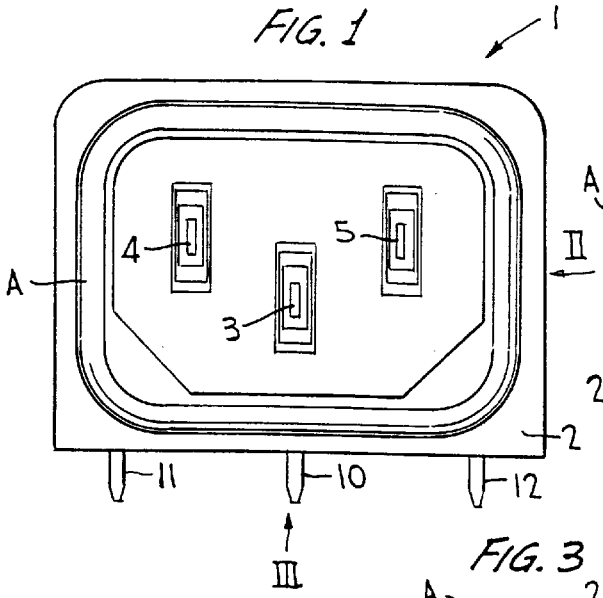
FIG. 1 is a front view of a plug for an appliance including a fuse (including an inserted fuse wire insert)
Figure 2:
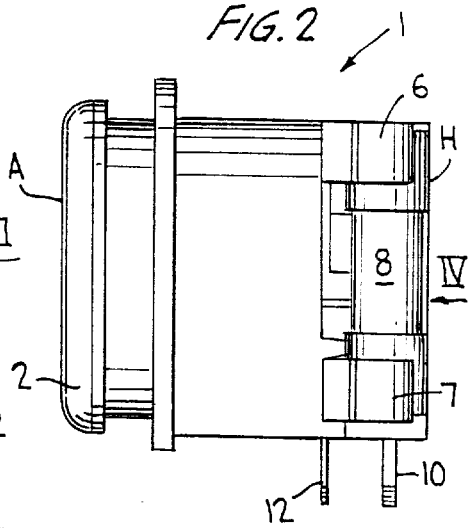
FIG. 2 is a side view according to the arrow II in FIG. 1.

Following reference numerals are used in the drawings:

1 Plug for appliance with integrated fuse

2 Insulating body (casing) of 1; integrally injection molded

3 Contact pin for protective lead

4 Contact pin for ground lead

5 Contact pin for phase

6 Clip (first) for fuse holder

7 Clip (second) for fuse holder

8 Fuse wire insert; interconnecting 6 and 7

9 Connecting lead from 5 to 6 (integrally with 6)

10 Inner connector for 3

11 Inner connector for 4

12 Inner connector of the clip 7, which is connected via 8, 6, 9 to 5; connected to 7

A Outer side of 1

H Inner side of 1

Figure 3:
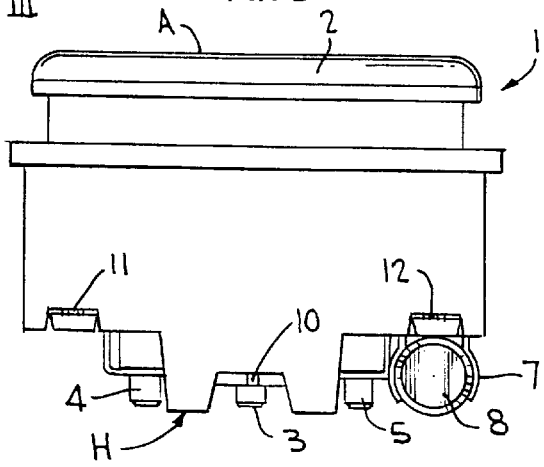
FIG. 3 is a bottom view according to the arrow III in FIG. 1.
Figure 4:
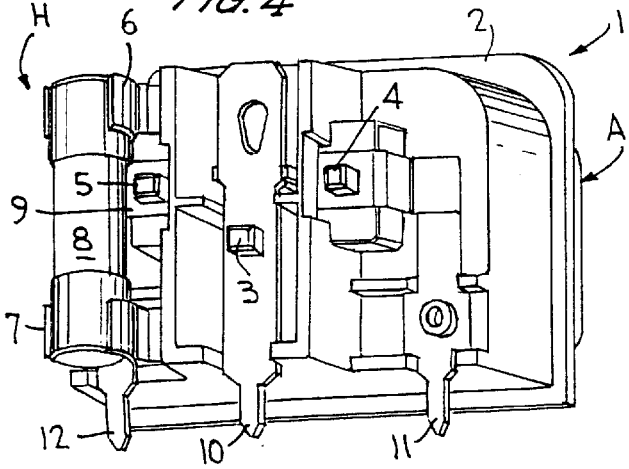
FIG. 4 is a perspective rear view in the sense of the arrow IV in FIG. 2.
Figure 5:
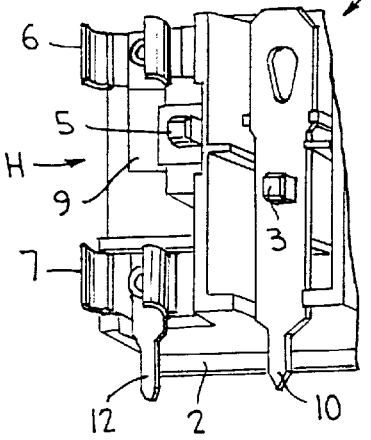
FIG. 5 is a fragment of FIG. 4 without a fuse wire insert.

At the outer side A, which is seen when viewing FIG. 1, contact pins 3 to 5 are visible, which are supported by the insulating body and extend to the inner side H (see specifically also FIGS. 3 and 5).

On the inner side H the protective lead contact pin 3 and the ground lead contact pin 4 are each directly connected to the corresponding connector 10 and 11, respectively.

However, the phase contact pin 5 is connected in and electrically conducting manner on the inner side by the connecting lead 9 to the first clip 6 of the fuse holder 2, se holder 2, 6, 7 consists of the two clips 6 an 7 and the insulating body 2 supporting the clips 6, 7 insulated from each other. The fuse wire insert 8 interconnectes by its (not illustrated) fusible conductor the clips 6 and 7 in an electrically conducting manner. The second clip 7 is in turn connected in an electrically conducting manner to the connector 12.

Thus, the fuse is located at the inside of the (not illustrated) appliance and can be exchanged only by a skilled person.

A fuse (analogue to 2, 6, 7, 8) can be foreseen for the ground lead, too. For sake of clarity it is not illustrated in the drawings.

Instead of the illustrated fuse (6, 7, 8) it could be possible to foresee a different fuse, for instance minimum fuses or minimum fuse wire inserts, such as micro-fuse inserts and SMD-fuse inserts. Suitable fuses are for instance fuse wire inserts according to International Electronical Commission 127 and Underwriter's Laboratories, Inc. 198.G standards.

Accordingly, it is possible to provide a plug for appliances with a plug which can be manufactured at a low price and to comply with the general safety regulations (without any complicated structures).

While there is shown and described a present preferred embodiment of the invention, it is to be distinctly understood that the invention is not limited thereto, but may be otherwise variously embodied and practiced within the scope of the following claims.

What is claimed is:

1. A fuse containing plug for mounting on an appliance with a replaceable fuse confined inside a housing for the appliance, comprising in combination, an insulation plug body having structure for receiving and supporting electrical contact pins for electrical connection between an electrical wire assembly outside the appliance and appliance electrical wiring inside the appliance, and plug body structure to non-removably mount the plug on an appliance with only the contact pin terminals for connecting the plug to the electrical wire assembly being accessible from outside of the appliance, wherein said plug body structure supports a replaceable fuse positioned on the plug body structure at a position to reside inside the appliance for making circuit connection between a contact pin accessible from outside the appliance and electrical wiring of the appliance thus requiring entry into the housing while the plug body structure is confined in place to replace the fuse.

2. The plug of claim 1 wherein said insulation plug body further comprises a common insulation body for supporting current carrying parts of the plug and current carrying parts of the fuse which consists of a single piece integrally molded insulation plug body.

3. A fuse containing electrical plug module for appliances for solving the problem of preventing access to the fuse from outside an appliance housing thereby to limit the exchange of fuses to skilled service personnel, comprising in combination:

a female insulation plug body supporting a set of female electrical power connections for receiving and supporting electric contact pins of an external mating male power plug, mounting structure for disposing the plug body non-removably on the appliances, a replaceable fuse retainer and a set of supporting electric connections confined inside said appliance housing inaccessible from the outside of the appliance housing for connecting power to the appliance through a fuse retained in said retainer, wherein said electrical connections comprise a fuse mounted internally on the plug body module to be inaccessible from outside the appliance housing.

4. A fuse assembly comprising in combination an insulated electrical female plug module, a set of female electrical connectors adapted to receive a male power line plug, means for mounting the module on an appliance housing for external access only to said female connectors, said module containing a replaceable fuse, and a set of internally disposed electrical connections, for internal connection to the appliance, and wherein said means for mounting includes structure for mounting the fuse assembly with the fuse located inside the appliance housing and inaccessible from outside the appliance housing.

* * * * *